United States Patent [19]

Lenk

[11] Patent Number: 4,826,462

[45] Date of Patent: May 2, 1989

[54] METHOD FOR MANUFACTURING A SPARK PLUG ELECTRODE

[75] Inventor: Michael Lenk, Overijse, Belgium

[73] Assignee: Champion Spark Plug Company, Toledo, Ohio

[21] Appl. No.: 234,369

[22] Filed: Aug. 19, 1988

[51] Int. Cl.[4] ..... H01T 21/02

[52] U.S. Cl. ..... 445/7; 427/34; 427/37

[58] Field of Search ..... 445/7; 427/34, 37; 313/141

[56] References Cited

U.S. PATENT DOCUMENTS

| | | | |
|---|---|---|---|
| 3,075,066 | 1/1963 | Yenni et al. | 427/37 X |
| 3,268,701 | 8/1966 | La Plante et al. | 200/166 |
| 3,673,452 | 6/1972 | Brennen | 313/141 |
| 3,854,067 | 12/1974 | Morgan | 313/130 |
| 4,122,366 | 10/1978 | von Stutterheim | 313/141 |
| 4,699,600 | 10/1987 | Kondo | 445/7 |
| 4,705,486 | 11/1987 | Myers et al. | 445/17 |

FOREIGN PATENT DOCUMENTS

| | | | |
|---|---|---|---|
| 934219 | 12/1963 | United Kingdom | 427/34 |

*Primary Examiner*—Kenneth J. Ramsey

*Attorney, Agent, or Firm*—MacMillan, Sobanski & Todd

[57] ABSTRACT

An improved method for manufacturing a spark plug electrode having a substrate formed from a first metal and a spark gap surface area formed from a second metal, such as a precious metal. The spark gap surface area is formed by heating the portion of the first metal at which the spark gap surface is to be formed with a plasma arc and applying the second metal as a consumable welding electrode, cooling the first metal and the applied second metal, and, optionally, shaping the second metal to form a desired surface configuration.

4 Claims, 1 Drawing Sheet

METHOD FOR MANUFACTURING A SPARK PLUG ELECTRODE

TECHNICAL FIELD

This invention relates to spark plug manufacturing and more particularly to an improved method for manufacturing a spark plug electrode having a spark surface formed from a corrosion and erosion resistant metal such as a precious metal.

BACKGROUND ART

During operation of a spark plug in an internal combustion engine, the portions of the center electrode and the ground electrode in the combustion chamber and particularly the portions which define the spark gap are subjected to corrosive combustion gases. Electrode erosion also is caused by the repetitive sparking. In recent years, the exposed surfaces of spark plug electrodes commonly have been produced from nickel alloys which resist corrosion and erosion. When longer life spark plugs are desired, the sparking surfaces of the electrodes may be formed from a precious metal, such as iridium, platinum, gold or silver, or from a precious metal alloy. Due to the extremely high cost of precious metals, manufacturing techniques are being developed to minimize the amount of precious metal required to produce these electrodes while maintaining an adequate bond between the precious metal and the base metal. One process involves welding a small disk or wafer of the precious metal to the base metal on the electrode. In another process, a small hole is formed in the end of an electrode blank, a piece of precious metal wire is inserted into the hole and the electrode blank is extruded. In each of these processes, it is necessary to handle very small pieces of the precious metal. There is a risk that the manufacturing equipment will fail to apply the precious metal to the electrode or that a defective bond will occur and consequently a defective spark plug may be manufactured. In other manufacturing processes, the precious metal is applied to the electrodes as a coating. However, if a gap occurs in the coating at the sparking surface, the electrode may be subject to premature failure.

DISCLOSURE OF INVENTION

According to the present invention, an improved method is provided for manufacturing a spark plug electrode having a corrosion and erosion resistant surface at the spark gap formed, for example, from a precious metal. The method permits precise control over the quantity of precious metal applied to the electrode and provides a very strong bond. The method of the invention involves applying an intense focused heat to the portion of the electrode to which the precious metal is to be applied by means of a plasma arc welding torch, applying a molten puddle of the precious metal to the electrode from a consumable welding electrode formed from the precious metal, cooling the electrode to solidify the metal, and, optionally, shaping the electrode into a final configuration through coining or other conventional techniques. The process allows precise application of only the amount of precious metal considered necessary to achieve the desired electrode durability by precision feeding a consumable precious metal wire into the plasma arc. Also, the extremely high temperatures generated in the plasma arc produce an intimate metallurgical bond between the applied metal and the substrate metal. The process eliminates the need to handle small pieces of the precious metal during manufacturing and eliminates the possibility of manufacturing a defective electrode because the small piece of precious metal was not applied or was incorrectly applied.

Accordingly, it is an object of the invention to provide an improved spark plug electrode having a precious metal sparking surface.

Other objects and advantages of the invention will be apparent from the following detailed description and the accompanying drawings.

BEST MODE FOR CARRYING OUT THE INVENTION

Figure 1:
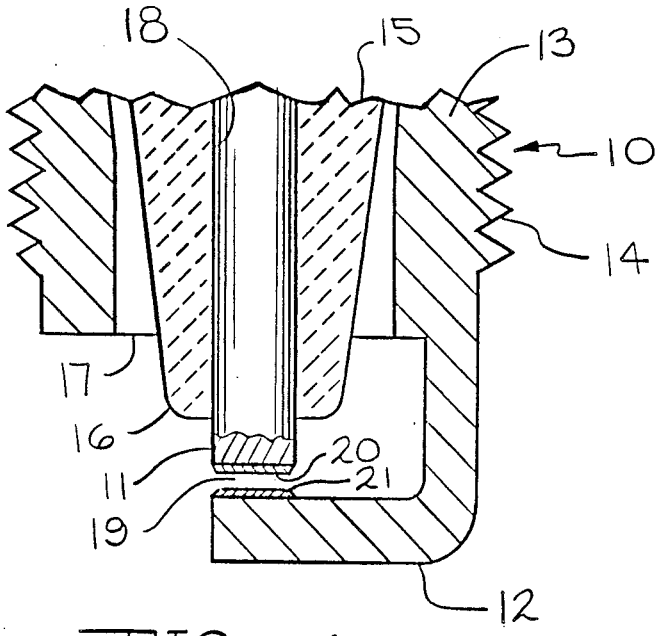
FIG. 1 is a fragmentary cross sectional view through the lower portion of a spark plug showing details of the center electrode and the ground electrode adjacent the spark gap.

Turning now to FIG. 1, a fragmentary cross sectional view is shown through the lower end of a spark plug 10 having a center electrode 11 and a ground electrode 12 formed in accordance with the method of the present invention. The spark plug 10 includes a generally tubular shell 13 having threads 14 for engaging a threaded spark plug hole in an engine cylinder head (not shown). An insulator 15 is mounted in the shell 13. The insulator 15 has a projecting end or nose portion 16 which terminates at or near a lower end 17 of the shell 13. The center electrode 11 is mounted in a bore 18 in the insulator 15 to project from the nose portion 16. The ground electrode 12 is welded to the lower shell end 17 and is bent to define a spark gap 19 relative to the center electrode 11.

The spark gap 19 is defined by a surface area 20 on the center electrode 11 and a surface area 21 on the ground electrode 12. At least the exposed surfaces of the electrodes 11 and 12, other than the surface areas 20 and 21, are formed from a corrosion resistant metal such as a nickel alloy. The interiors of the electrodes 11 and 12 may be of the same material as the surface, or may be of a material having a high thermal conductivity such as copper. According to the invention, an improved method is provided for applying a metal having a greater corrosion and erosion resistance to either or both of the electrode surface areas 20 and 21. Preferably, the metal is a noble metal such as platinum or iridium or another precious metal such as gold or silver, or an alloy of one of these metals.

Figure 2:
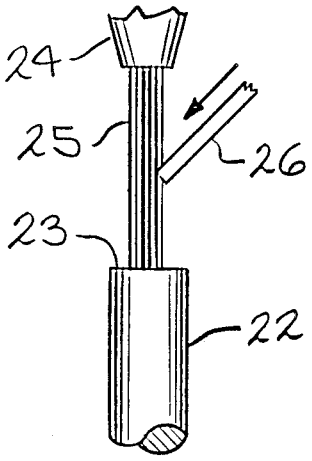
FIG. 2 is a diagrammatic view illustrating a first step in manufacturing a spark plug electrode according to the invention.
Figure 3:
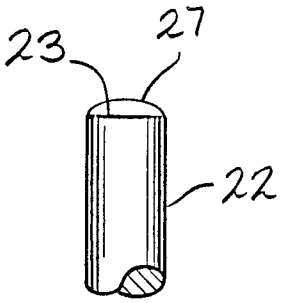
FIG. 3 is a fragmentary elevational view of a spark plug center electrode showing its appearance after precious metal is applied to the sparking end.
Figure 4:
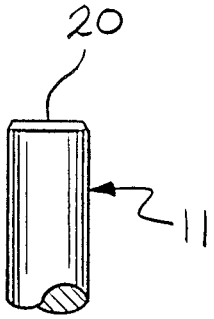
FIG. 4 is a fragmentary elevational view of the spark plug center electrode of FIG. 3 after shaping by coining.

The method of the invention for applying precious metal to the electrode area 20 on the center electrode 11 is illustrated in FIGS. 2–4. As shown in FIG. 2, the center electrode has a body 22 formed either as a solid wire of a corrosion resistant metal such as nickel or a nickel alloy or as a core (not shown) of a material having a high thermal conductivity sheathed in the corrosion resistant metal. The body 22 has an end area 23 to which a second metal is applied in making the center electrode 11. Initially, a nozzle 24 of a plasma arc welding torch is positioned to direct a plasma jet 25 at the end area 23.

In a plasma arc welding torch, an arc is drawn inside the torch between a non-consumable electrode and a water cooled nozzle. An inert gas such as argon or nitrogen is passed through the arc where it is heated to a very high temperature and ionized and then it is discharged from the nozzle as a narrow highly concentrated plasma stream containing ionized particles. An electric arc is combined with the plasma stream to form a plasma arc capable of delivering a highly concentrated heat to an area being welded. Plasma arc welding is characterized by deep penetration and welds with narrow beads and sharply limited heat-affected zones.

As the plasma jet 25 rapidly heats the end area 23, a consumable welding electrode 26 is precisely fed into the plasma to cause a precise amount of the welding electrode metal to be deposited on the end area 23. Although any desired metal may be deposited to the electrode end area 23, preferably the deposited metal is a noble metal such as platinum or iridium or another precious metal such as gold or silver or a precious metal alloy.

The deposited welding electrode metal is shown at 27 in FIG. 3. Because the metal is completely molten when deposited and due to surface tension, the deposited metal 27 will tend to have a curved outer surface extending across the end area 23 of the electrode body 22. After the deposited metal 27 has cooled and solidified, it can be shaped, if desired, by coining or by other known means to form a flat spark surface area 20 on the center electrode 11, as shown in FIG. 4. The center electrode 11 then is assembled into a finished spark plug 10 by any desired assembly method.

Normally, a spark plug is operated with the center electrode at a negative potential relative to the ground electrode. As a consequence, the center electrode is subjected to significantly greater erosion than the ground electrode. Spark plugs are sometimes made with only the center electrode having its spark surface area 20 formed from precious metal. At other times, the spark gap surfaces on both the center electrode and the ground electrode are formed from precious metal. When the ground electrode 12 (FIG. 1) is to be provided with a precious metal spark surface area 21, the precious metal can be applied to the body of the ground electrode 12 by the same method used to apply it to the center electrode 11.

It will be appreciated that various modifications and changes may be made to the above described method for manufacturing a spark plug electrode without departing from the spirit and the scope of the following claims.

I claim:

1. A method for manufacturing a spark plug electrode, said electrode having a surface area for forming one side of a spark gap, said method comprising the steps of:

(a) forming an electrode substrate having a surface formed from a first metal;

(b) heating a predetermined area of said substrate adjacent the spark gap surface area with a plasma arc; and (c) feeding a welding electrode formed from a second metal into said plasma arc to cause a predetermined amount of second metal to be deposited on said predetermined area to form said spark gap surface area.

2. A method for manufacturing a spark plug electrode, as set forth in claim 1, and further including the steps of cooling the second metal deposited on such predetermined area, and shaping the deposited second metal to impart a predetermined shape to said spark gap surface area.

3. A method for manufacturing a spark plug electrode, as set forth in claim 2, wherein the deposited second metal is shaped by coining.

4. A method for manufacturing a spark plug electrode, as set forth in claim 1, wherein a welding electrode formed from a second metal selected from the group consisting of platinum, iridium, gold, silver or an alloy of platinum, iridium, gold or silver is fed into the plasma arc for depositing on said predetermined area to form said spark gap surface area.

* * * * *